US007269863B1

(12) United States Patent
Blevins

(10) Patent No.: US 7,269,863 B1
(45) Date of Patent: Sep. 18, 2007

(54) AUTOMATIC SELF-CLEANING TOILET

(76) Inventor: William J. Blevins, 2549 Piketon Rd., Lucasville, OH (US) 45648

( * ) Notice: Subject to any disclaimer, the term of this patent is extended or adjusted under 35 U.S.C. 154(b) by 0 days.

(21) Appl. No.: 11/378,940

(22) Filed: Mar. 17, 2006

(51) Int. Cl.
*A47K 4/00* (2006.01)
*E03C 1/01* (2006.01)

(52) U.S. Cl. ..... 4/662

(58) Field of Classification Search ..... 4/319–320, 4/662

See application file for complete search history.

(56) References Cited

U.S. PATENT DOCUMENTS 3,919,726 A * 11/1975 Godwin et al. ..... 4/312
4,174,546 A * 11/1979 Ohtake ..... 4/420
4,301,558 A * 11/1981 Decaux ..... 4/420
4,797,959 A * 1/1989 Decaux ..... 4/662
5,090,069 A * 2/1992 Decaux ..... 4/662
5,279,008 A * 1/1994 Ritter ..... 4/662
6,944,894 B1 * 9/2005 Blevins ..... 4/662

* cited by examiner

*Primary Examiner*—Charles E. Phillips
(74) *Attorney, Agent, or Firm*—Donald W. Meeker

(57) ABSTRACT

A toilet bowl automatically flushes and lowers within a cylinder to a cleaning position. The interior of the bowl is then contacted by a brush cleaning assembly, including a detergent spray and water rinse and then is raised back up to the ready-for-use position.

4 Claims, 4 Drawing Sheets

AUTOMATIC SELF-CLEANING TOILET

CROSS-REFERENCE TO RELATED APPLICATIONS

Not Applicable.

STATEMENT REGARDING FEDERALLY SPONSORED RESEARCH OR DEVELOPMENT

Not Applicable.

THE NAMES OF THE PARTIES TO A JOINT RESEARCH OR DEVELOPMENT

Not Applicable.

BACKGROUND OF THE INVENTION

1. Field of the Invention

The present invention relates to self-cleaning toilets and particularly to a toilet bowl that automatically flushes and lowers within a cylinder to a cleaning position, the interior of the bowl is then contacted by a brush cleaning assembly, including a detergent spray and then is raised back up to the ready-for-use position.

2. Description of Related Art Including Information Disclosed Under 37 CFR 1.97 and 1.98

Cleaning a toilet is important for both aesthetic and health reasons. In addition to the waste that may soil the toilet bowl, a great many water supply systems have bacteria or minerals or other matter that causes stains and deposits in water that is left sitting for any period of time, particularly around the water line. Cleaning toilets in not a pleasant task and few people are likely to enjoy the job, so that it may not be cleaned for a long period of time. The longer the time between cleanings, the more difficult the task becomes because the stains set into the porcelain and require major scrubbing and chemicals to remove them.

While some attempts have been made by the prior art to solve the problem, they do not adequately address the need for high frequency and intensity of cleaning.

U.S. Pat. No. 4,210,973, issued Jul. 8, 1980 to Decaux, puts forth a sanitary unit that comprises at least one vessel such as a bowl, basin or a lavatory pan. In this unit the vessel is movable between a position of use and a cleaning position. The unit comprises rotary brush for cleaning the vessel when the latter is in its cleaning position and means for controlling the displacement of the vessel between the two positions and means for actuating the rotary brush.

U.S. Pat. No. 5,279,008, issued Jan. 18, 1994 to Ritter, concerns a sanitary cell with automatic cleaning device for the toilet bowl. The sanitary cell includes a sanitary chamber, a first technical equipment chamber, for accommodating toilet bowl cleaning appliances, and a wall, which separates the two chambers and which supports, on its opposite sides, two toilet bowls which are located in the sanitary and first technical equipment chambers, respectively. The toilet bowl, which is located in the sanitary chamber, has an opening, which points upwardly. The toilet bowl, which is located in the first technical equipment chamber, has an opening, which points downwardly. A second technical equipment chamber is located beneath the floor of the sanitary chamber. A separating wall pivots about a horizontal axis to enable the pivoting of the toilet bowls from the first technical equipment chamber, through the second technical equipment chamber, and into the sanitary chamber, so that the toilet bowls can be cleaned. The sanitary and technical equipment chambers have respective openings in the area of the respective bowls so as to accommodate their pivotal movement.

U.S. Pat. No. 3,919,726, issued Nov. 18, 1975 to Godwin, puts forth a self-cleaning water closet wherein either the bowl or a specifically provided cabinet-type enclosure is pivotally movable between a first non-cleaning position and a second cleaning position. When in the cleaning position, the cabinet-type enclosure sealably encloses at least a portion of the bowl before washing begins.

U.S. Pat. No. 3,829,906, issued Aug. 20, 1974 to McPhee, concerns a hospital patient care unit, which consists of a folding toilet in a compact cabinet wherein the cowl of the toilet is removable so that the unit can be used either as a bedpan or in the normal manner. The unit is designed so that when it is closed, the bowl is automatically flushed and washed out and an interlock prevents opening the cabinet while the flushing operation is taking place.

U.S. Pat. No. 4,726,079, issued Feb. 23, 1988 to Signori, is for a height adjustable toilet bowl, which includes a water-actuated cylinder for moving it between a low position and a high position. The toilet bowl has a cleaning water circuit adapted to be connected to a water supply pipe, a hose interposed between the cleaning water circuit and the water supply pipe and an outlet pipe connected to a discharge duct through an extensible pipe. The water-actuated cylinder is a flexible cylinder connectable selectively to the water supply pipe and to the cleaning water circuit through a three position valve, a pipe being interposed between the flexible cylinder and the three position valve.

U.S. Pat. No. 5,647,074, issued Jul. 15, 1997 to White, Jr., shows a public toilet facility which is self-cleaning, automatic, and handicapped accessible. The facility offers a toilet that not only lowers from a vertical position to a horizontal position, but can also be adjusted vertically to different heights. High-pressure water jet nozzles are provided within the facility for high pressure cleaning of the toilet bowl and seat when the bowl is in the vertical position. The compact facility has a semicircular door, which is stored behind the equipment and machinery compartment when the facility is unoccupied.

U.S. Pat. No. 5,090,069, issued Feb. 25, 1992 to Decaux, claims a self-cleaning sanitation module that comprises a toilet pan movable between a use position and a cleaning position in which it is behind a separating wall. A back is provided movable between two positions, a use position and a cleaning position in which the back in disposed vertically above the pan. The displacement of the pan and the back between their use position and their cleaning position is performed in such a way that there is always a very small gap between the back and the pan.

U.S. Pat. No. 5,765,237, issued Jun. 16, 1998 to Okamoto, describes a flush pot assembly having a pot, which is concealed when it is not being used. The pot can be easily accessed for use and washed with washing water after use even by a disabled person or a hospital patient. The flush pot assembly includes a pot connected to a flexible drain hose for passing washing water. The pot is provided such that it is integral with a back surface of a door. The door can be opened and closed and constitutes part of one side of a room. The flexible drain hose is connected between the pot and a drainpipe, which leads to the outside of the room. The pot is moved into the room by opening the door and is accommodated in a space outside the room by closing the door.

U.S. Pat. No. 4,797,959, issued Jan. 17, 1989 to Decaux, discloses a sanitary unit having an automatic cleansing cycle. The unit comprises a lockable enclosure in which a partition defines a usage zone and a maintenance zone. A bowl is mounted for rotation between a utilization position in which it projects horizontally from the partition in said usage zone and a cleaning position in which it is tipped up into an opening in the partition so as to empty it into the maintenance zone. The upwards opening of the bowl is separated into two sections by a partition wall which extends upwardly to cooperate with the front walls of the bowl to form a rim surrounding the utilization section of the bowl. The bottom of the partition wall stops short of the base of the bowl to define an orifice and the rear section of the bowl forms an evacuation passage from the evacuation orifice rearwards to the maintenance zone when the bowl is tipped up.

U.S. Pat. No. 4,301,558, issued Nov. 24, 1981 to Decaux, indicates a sanitary unit of the type comprising a vessel, which is mounted to be movable between a position of use and a cleaning position. In the swung over cleaning position, the pan faces the rotary brush and the back part closes the upper part of the drum of the brush so as to preclude any projection of water outside the drum. Further, the drum comprises a water supply system provided with radial perforations, which extend throughout the generatrix of the brush so as to spray the latter and complete the cleaning. The fluid supplied by the system may be pure water or water to which an anti-bacteria or anti-microbe disinfecting solution has been added.

U.S. Pat. No. 5,446,928, issued Sep. 5, 1995 to Daniels, discloses a lift to flush toilet stool. The toilet stool includes a bowl supported above the ground, a flexible hose connecting the bowl to a sewer pipe and a support member for releasably retaining the flexible hose in a trap configuration. The bowl is lifted and the flexible hose substantially straightened to flush the toilet stool.

U.S. Pat. No. 4,091,473, issued May 30, 1978 to Matthews, indicates an adjustable toilet mounted on the wall of a bathroom. The toilet is raised and lowered by an electrically driven motor. By raising and lowering the toilet, the elderly, the handicapped, and children are aided in the use of the toilet. The toilet provides electrical limit switches for stopping the motor at a desired height above the bathroom floor.

What is needed is a toilet cleaning system which works automatically with every flush providing both intense brushing and detergent cleaning.

BRIEF SUMMARY OF THE INVENTION

An object of the present invention is to provide a toilet cleaning system which works automatically with every flush providing both intense brushing and detergent cleaning always leaving the toilet bowl fresh for the next user and never letting stains build up on the porcelain.

Another object of the present invention is to provide a self-cleaning toilet system which resembles an ordinary toilet in shape and method of use, but which works automatically upon closing the lid to flush, brush, and clean the toilet bowl with detergent and water spray.

One related object of the present invention is to provide a self-flushing and self-cleaning toilet which has a normal seat height but provides a cylinder recessed below floor level in which the toilet bowl automatically descends after the automatic flush and receives a rotary high intensity rotating brush assembly and detergent spray to clean the bowl including a water rinse and then automatically returns the toilet bowl to the normal use level fresh and clean for the next user.

In brief, a toilet bowl is positioned at a normal height within a cabinet housing the inner works of the self-flushing, self-cleaning toilet. Upon closing the lid over the toilet seat after use, the toilet automatically flushes and lowers inside a sealed cylinder down below the floor level. A motor and spiral impeller assist gravity to guarantee a clean flush of all matter in the bowl. The bowl lowers onto a brush assembly with rotary brushes which pivot out from a center post to contact the bowl and thoroughly cleans the bowl. A water spray removes any loose matter as well as detergent residue. The toilet bowl is then lifted back to the normal use position fresh and clean for the next user. Liquid seals and flexible waste lines and water lines and detergent lines enable the movement of the elements.

An advantage of the present invention is that it automatically cleans the toilet bowl with every flush always leaving the toilet bowl fresh for the next user and never letting stains build up on the porcelain.

Another advantage of the present invention is that it is a self-cleaning toilet system which resembles an ordinary toilet in shape and method of use, but which works automatically upon closing the lid.

A further advantage of the present invention is that it conceals all of the cleaning elements and has a normal seat height.

BRIEF DESCRIPTION OF THE SEVERAL VIEWS OF THE DRAWINGS

These and other details of my invention will be described in connection with the accompanying drawings, which are furnished only by way of illustration and not in limitation of the invention, and in which drawings.

DETAILED DESCRIPTION OF THE INVENTION

In FIGS. 1-6, a self-cleaning toilet system 20 automatically scrubs a toilet bowl clean with every flush. The system comprises a cabinet 30 housing a movable toilet bowl 21 and lower center brush assembly 11.

Figure 1:
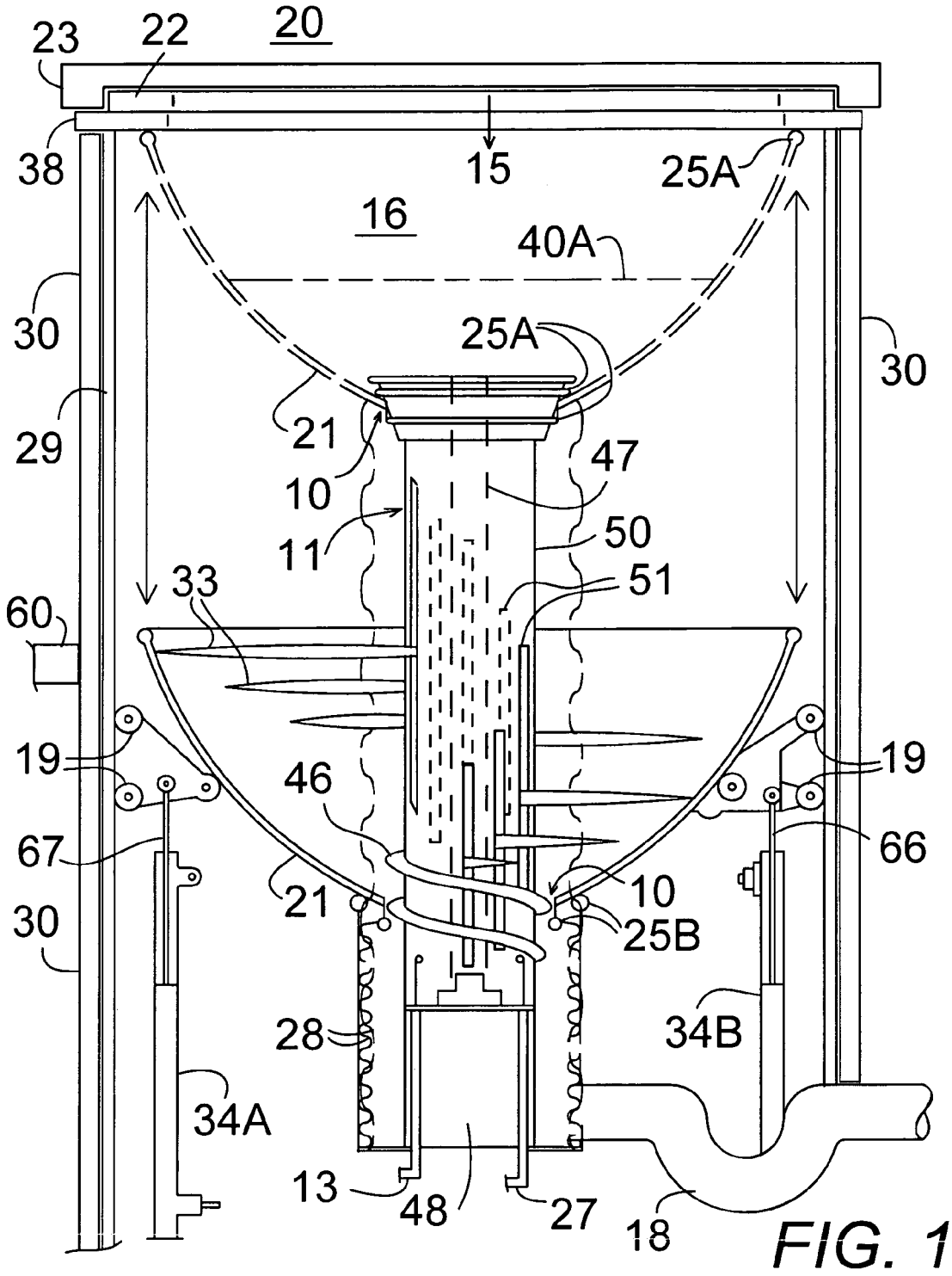
FIG. 1 is a cross-sectional view of the automatic flushing and self-cleaning toilet system of the present invention showing the main toilet bowl and brush assembly components in the cabinet.

In FIG. 1, the cabinet 30 is mounted partially below and partially above a level of a floor 60. A top cover 38 of the cabinet is at a height of a standard toilet bowl. The cabinet 30 comprises an enclosure with a hollow interior and a top cover 38 having a top cabinet opening 15 therethrough and a hinged toilet seat ring 22 and toilet seat cover 23 pivotally mounted over the top opening 15.

A toilet bowl 21 is movably positioned within the vertical sealed cylinder 29 inside the cabinet below the top cabinet opening 15 normally in a first usage position (dashed lines)

in contact with the top cover 38. The toilet bowl has a waste receiving bowl interior 16 and a top bowl opening seal 25A contacting the top cover 38, the toilet bowl opening coinciding with the top cabinet opening 15 for use in communication with the waste receiving bowl interior 16.

The toilet bowl 21 is adapted to move from the upper first usage position (dashed lines) down to a lower second cleaning position (solid lines) below the first position riding on rollers 19 contacting the walls of the sealed cylinder 29 between the two positions, and after cleaning back up to the first position (dashed lines).

A contractible and extendable drainage tube, such as an accordion rubberized tube 28, shown dashed in the first usage position and solid in the second cleaning position of the bowl, is attached at a top end to the bottom opening of the toilet bowl with a seal 25B in communication with the waste receiving bowl 21 and attached at a bottom end to a trap 18A leading to a sewer system, the drainage tube adapted to remain attached at both ends during movement of the toilet bowl 21.

Figure 5:
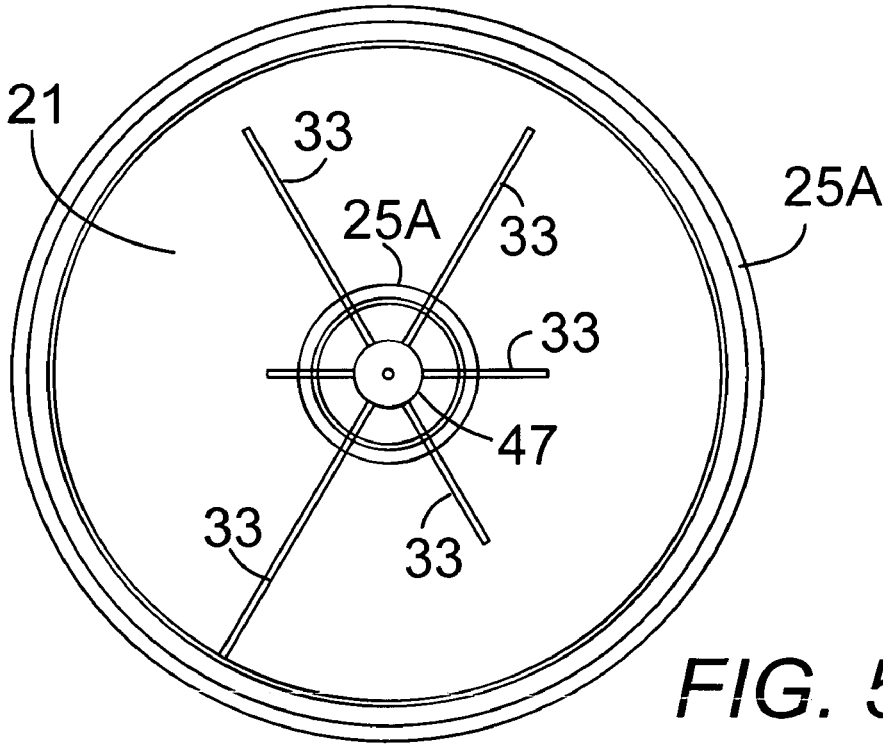
FIG. 5 is a top plan view of the toilet bowl showing the brush structure with the brushes open for use in the bowl.
Figure 6:
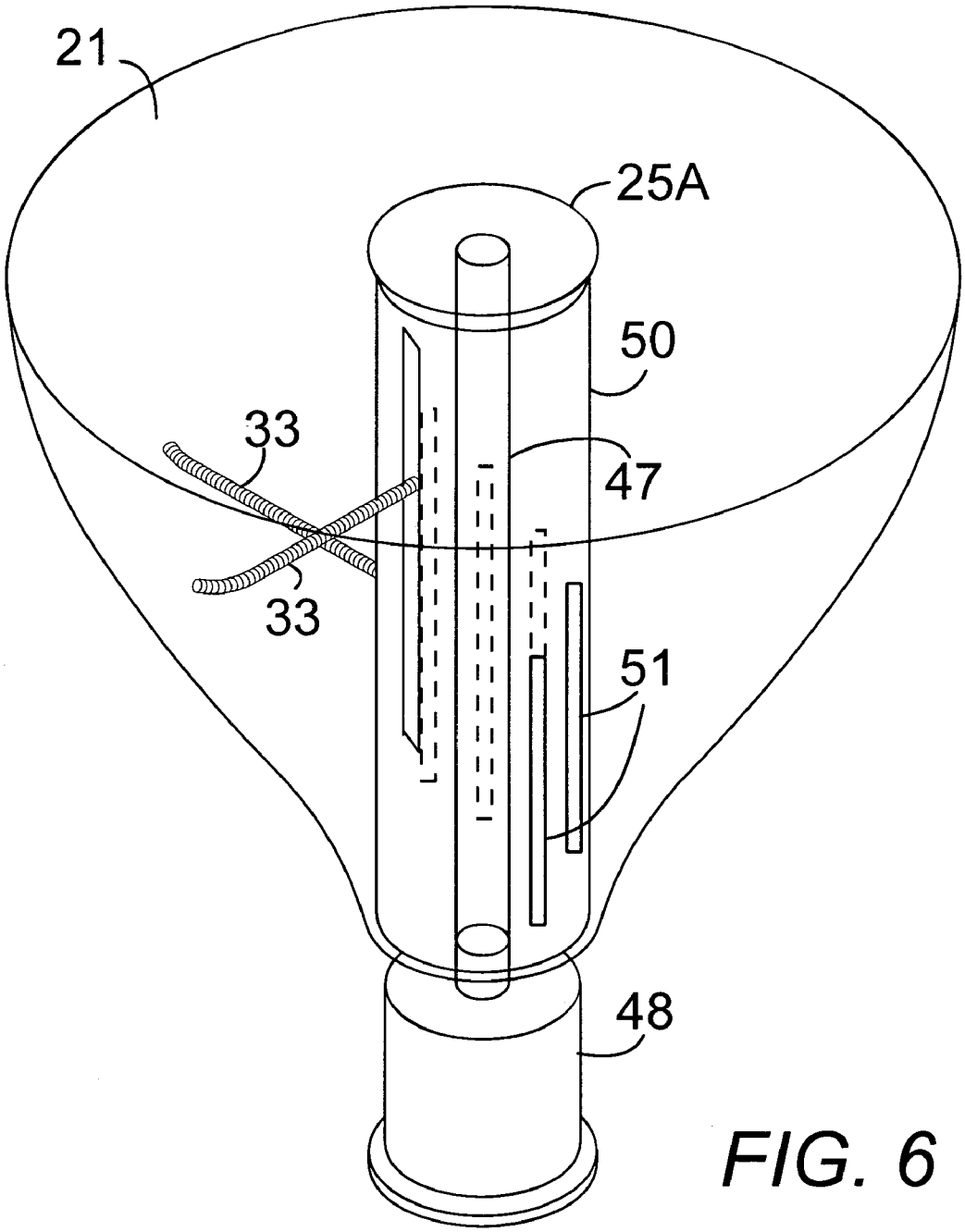
FIG. 6 is a perspective view of the toilet bowl and brush assembly showing two of the brushes open for use in the bowl.

In FIGS. 1, 5, and 6, a brush assembly 50 is rigidly attached to the bottom of the cabinet, the brush assembly having a top seal 25A sealing the bottom opening 10 of the toilet bowl 21 with the bowl in the upper first usage position (shown dashed). Upon closing the seat lid 23, the toilet bowl automatically descends within the cabinet 30 down the length of the brush assembly 11 so that the bottom opening 10 of the bowl is adjacent to the impeller 46 which assists gravity in removing the waste and water from the bowl 21. The scrubbing brushes 33 pivot downward and outward from the spindle casing between an inner post 47 and an outer shell 50 through vertical recesses 51 positioned in a descending spiral around the outer shell 50 so that the brushes contact the interior of the bowl 21. The motor 48 is activated automatically to spin the brush assembly 11 for a set period of time controlled by a timer 70, shown in FIG. 2, which is activated by a timer with a connector 68 communicating with a sensor to detect the closing of the seat lid 23. Detergent from a detergent reservoir and detergent conduit 13 is sprayed into the brush assembly and flushing water from a water conduit 27 is sprayed into the brush assembly to wash away the detergent and any residue. After scrubbing, the bowl 21 ascends back up to the first usage position (shown dashed), where the top bowl opening seal 25A seals the bottom bowl opening 10 and the bowl fills partially with water 40 to be ready for use. The bottom opening 10 of the bowl causes the brushes 33 to move back up and into the vertical recesses 51.

Figure 2:
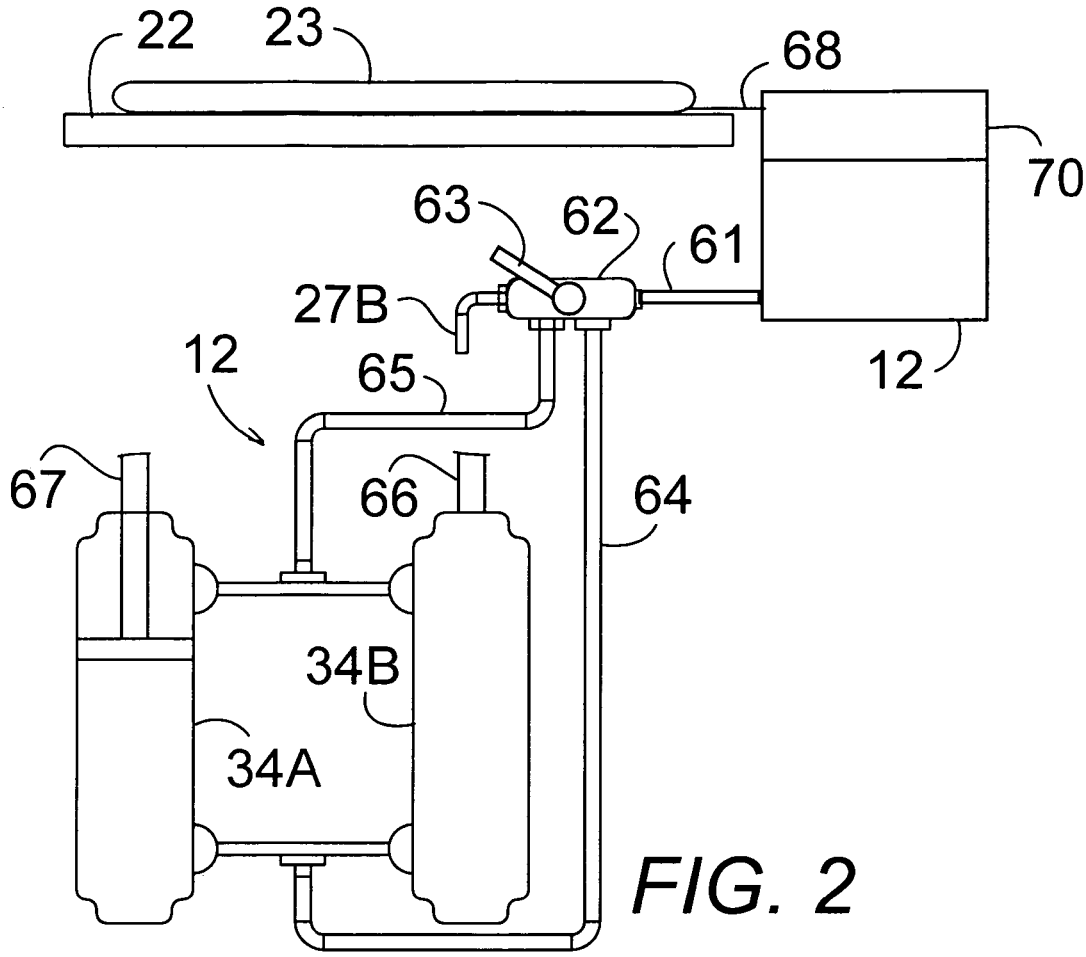
FIG. 2 is a diagrammatic view of the water supply system and hydraulic lift system of the present invention of FIG. 1.
Figure 3:
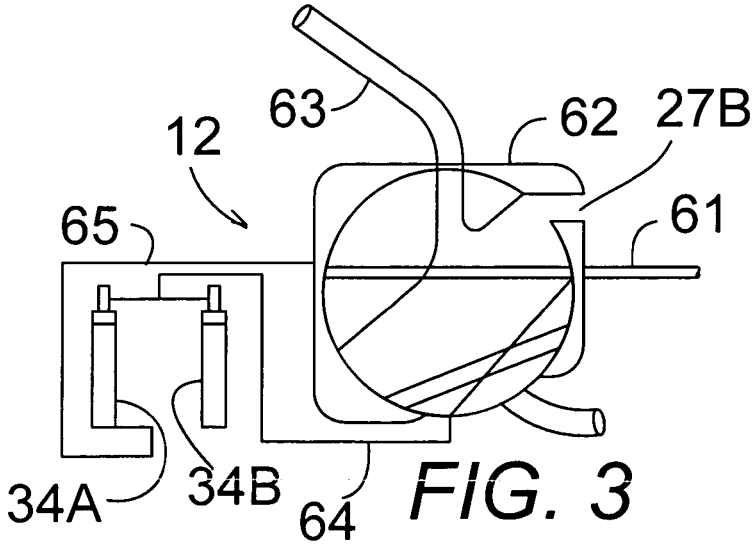
FIG. 3 is a diagrammatic view of the water supply system and hydraulic lift system of FIG. 2 showing a cross-sectional view of the control valve.
Figure 4:
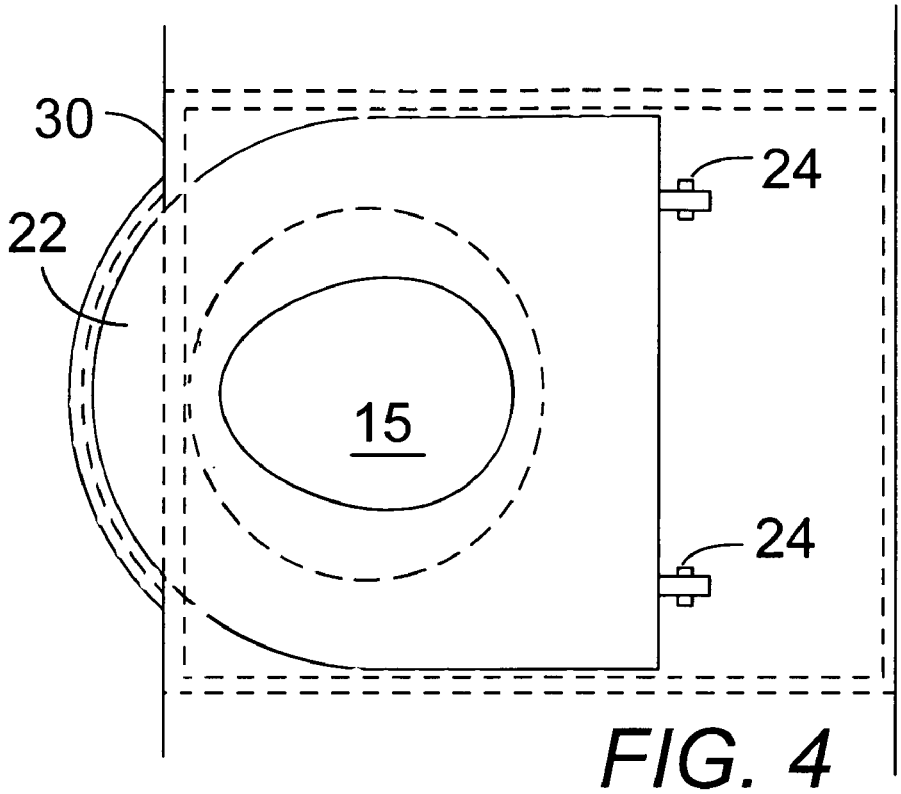
FIG. 4 is a top plan view of the top of the cabinet cover showing the toilet seat in the down position for usage.

In FIGS. 2 and 3, the water supply and hydraulic system 12 of the present invention comprises a water supply 12 with a water conduit 61 leading to a water supply control valve 62 having a control lever 63 which directs the water flow to a backflow water conduit 27B into the toilet bowl 21 and into at least two hydraulic cylinders 34A and 34B which move the toilet bowl 21 up and down by the piston arms 66 and 67.

The toilet bowl 21 my be fabricated of porcelain or stainless steel or other materials normally used for that purpose.

In use, normally the toilet bowl 21 is in the up position ready for usage and the toilet seat 22 and the toilet seat cover 23 are in the down (closed) position. The top of the toilet bowl 22 is sealed against the top cover 38 of cabinet enclosure 30 from all working parts of this appliance. All working parts are in an inactive mode normally. The toilet seat cover 23 and/or toilet seat ring 22 can then be raised for use.

After use, the toilet seat cover 23 and toilet seat ring 22 are pivoted downward to cover the toilet bowl opening to return to the closed position to activate the cleaning cycle or the seat cover 23 can remain up thus delaying the cleansing cycle activation. Closing the toilet seat cover 23 automatically activates the lifter lowering hydraulic cylinders (preferably two) 34A and 34B, which control the descent of the toilet bowl 21, along with expandable, collapsible drainage tubing 28 to the down cleaning position.

Upon settling into the cleaning position (shown solid in FIG. 1), the bottom of toilet bowl automatically de-activates the lifter/lowering hydraulic cylinders and automatically activates action of the impeller 46 and the scrubbing brushes 33 and detergent spray and water spray to begin cleansing of the toilet bowl 21 and adjunct parts.

Upon completion of the waste discharge/cleaning cycle, the impeller and scrubbing brushes are automatically deactivated. Simultaneously, the water pressurized lifter/lowering hydraulic cylinders are automatically activated, causing the toilet bowl 21 to ascend to the up (use) position, sealing the bottom toilet bowl opening and the toilet bowl is partially filled with water to a pre-set level when the water automatically shuts off so that the toilet bowl is ready for use upon lifting of toilet seat cover.

A delay button located at a front edge of the enclosure cabinet may be used to delay cleansing/waste discharge cycle activation.

The automatic self-cleaning toilet of the present invention may be used in residential bathrooms as well as other locations such as doctor's offices, service stations, markets, restaurants, parks, hospitals, clinics, wherever residential type toilets are now used. It replaces the ongoing drudgery of manual toilet cleaning with a virtually maintenance free toilet cleaning system.

It is understood that the preceding description is given merely by way of illustration and not in limitation of the invention and that various modifications may be made thereto without departing from the spirit of the invention as claimed.

What is claimed is:

1. An automatic self-cleaning toilet system for automatically scrubbing a toilet bowl clean with every flush, the system comprising:

a cabinet mounted partially below and partially above a level of a floor with a top of the cabinet at a height of a standard toilet bowl, the cabinet comprising an enclosure with a hollow interior and a top cover having a top cabinet opening therethrough and a hinged toilet seat ring and toilet seat cover pivotally mounted over the top opening, and a vertical sealed cylinder mounted inside the cabinet;

a toilet bowl movably positioned within the vertical sealed cylinder inside the cabinet below the top cabinet opening normally in a first usage position in contact with the top cover, the toilet bowl having a waste receiving bowl interior, a top bowl opening for use in communication with the waste receiving bowl interior, at least one water inlet into the toilet bowl, a bottom opening for drainage, a means for moving the toilet bowl vertically within the vertical sealed cylinder so that the toilet bowl moves from the first usage position down to a second cleaning position below the first position, and after cleaning back up to the first usage position;

at least two hydraulic cylinders, each having a movable piston arm, attached between the cabinet and the toilet bowl for moving the toilet bowl reversibly between the first usage position and the second cleaning position;

a contractible and extensible drainage tube attached at a top end to the bottom opening of the toilet bowl in communication with the waste receiving bowl interior and attached at a bottom end to a trap leading to a sewer system, the drainage tube adapted to remain attached at both ends during movement of the toilet bowl;

a brush assembly is rigidly attached to the cabinet, the brush assembly comprising an inner post inside a spaced outer shell forming a vertical spindle casing therebetween; a top seal sealing the bottom opening of the toilet bowl when the bowl is in the first usage position, wherein the toilet bowl descends down the length of the brush assembly to the second cleaning position when the bottom opening of the toilet bowl is adjacent to the bottom of the brush assembly; a series of scrubbing brushes each pivotally attached to the inner post and each normally positioned inside one of a series of vertical recesses in the outer shell spaced apart and positioned around the outer shell in a descending spiral, each of the brushes pivoting downwardly and outwardly into contact with the toilet bowl upon the descent of the toilet bowl and pivoting upwardly and inwardly within the spindle casing upon the ascent of the toilet bowl by contact of the bottom opening of the toilet bowl with the scrubbing brushes; a motor attached to the cabinet at a bottom end of the brush assembly for spinning the brush assembly to scrub an interior of the toilet bowl; a detergent conduit extending into the brush assembly and a water conduit extending into the brush assembly for spraying detergent and water into the interior of the toilet bowl;

a back flow water conduit communicating between a water source and the toilet bowl for partially filling the toilet bowl with water with the toilet bowl in the first usage position;

a water control valve for controlling a flow of water to the at least two hydraulic cylinders for moving the toilet seat and the back flow water conduit;

a means for sensing closure of the toilet seat cover over the toilet seat ring;

a control device connected to the means for sensing closure of the toilet seat cover, the control device comprising a means for controlling the at least two hydraulic cylinders to move the toilet seat up and down, a means for controlling the motor to rotate the brush assembly, a means for controlling the detergent sprayer, a means for controlling the water sprayer, and a means for controlling the back flow water conduit, the control device further comprising a timer so that closure of the toilet seat cover activates the control device to perform a timed sequence of events to flush water into the toilet bowl, lower the toilet seat from the first usage position to the second cleaning position, activate the scrubbing brushes and detergent spray and water spray of the brush assembly, raise the toilet seat to the first usage position and partially fill the toilet bowl with water.

2. The system of claim 1 further comprising rollers between the toiled bowl and the sealed cylinder for engaging an interior of the vertical sealed cylinder for guiding movement of the toilet bowl therein.

3. The system of claim 1 wherein the drainage tube is an accordion tube.

4. The system of claim 1 further comprising a spiral impeller within the drainage tube controlled by the motor to rotate to assist gravity in removing waste matter from the toilet bowl.

* * * * *